US009596889B1

(12) United States Patent
Gambuzza

(10) Patent No.: US 9,596,889 B1
(45) Date of Patent: Mar. 21, 2017

(54) PERMANENTLY FOLDED MAGNETIC POCKET SQUARE

(71) Applicant: Anthony Gambuzza, Fort Meyers, FL (US)

(72) Inventor: Anthony Gambuzza, Fort Meyers, FL (US)

( * ) Notice: Subject to any disclaimer, the term of this patent is extended or adjusted under 35 U.S.C. 154(b) by 0 days.

(21) Appl. No.: 15/345,978

(22) Filed: Nov. 8, 2016

Related U.S. Application Data

(62) Division of application No. 14/617,209, filed on Feb. 9, 2015, now Pat. No. 9,516,903.

(51) Int. Cl.
*A41B 15/02* (2006.01)
*A41D 1/02* (2006.01)
*A41D 27/20* (2006.01)

(52) U.S. Cl.
CPC ..... *A41B 15/02* (2013.01); *A41D 1/02* (2013.01); *A41D 27/20* (2013.01)

(58) Field of Classification Search
CPC ..... A41B 15/00; A41B 15/02
See application file for complete search history.

(56) References Cited

U.S. PATENT DOCUMENTS 2,022,793 A 12/1935 Trickel
2,269,511 A * 1/1942 Biederman ..... A41B 15/02 2/279
2,379,092 A 6/1945 Maschoff
2,722,013 A 11/1955 Fisher
2,738,515 A 3/1956 Owen
2,815,509 A 12/1957 Williamson
2,968,045 A 1/1961 Johnson
3,072,917 A 1/1963 Watson, Jr.
3,135,030 A 6/1964 Weber
3,514,790 A 6/1970 Harvey
4,897,900 A 2/1990 Baggett
5,231,702 A 8/1993 Masters
5,253,370 A 10/1993 Mead
6,006,455 A 12/1999 Miller
6,412,118 B1 7/2002 Shanklin
6,519,779 B1 2/2003 Taguchi
7,107,627 B2 9/2006 Holland
8,347,417 B1 1/2013 Chur
8,615,853 B2 12/2013 Rathbun
(Continued)

FOREIGN PATENT DOCUMENTS

WO WO2008136205 11/2008

*Primary Examiner* — Shaun R Hurley
*Assistant Examiner* — Andrew W Sutton
(74) *Attorney, Agent, or Firm* — Goldstein Law Offices, P.C.

(57) ABSTRACT

A pocket square, for use with a jacket having an inside surface, an outside surface, and a pocket on the outside surface having a top edge. The pocket square has a base having a top edge and a magnetically attractive core, and a decorative portion extending from the top edge of the base. When the base is placed in the pocket its top edge is aligned with the top edge of the pocket, visibly displaying the decorative portion above the pocket. A magnetic plate is aligned with the magnetically attractive core and placed against the inside surface of the jacket to positionally fix the base within the pocket, such that the pocket square remains in position for the duration that the jacket is worn.

10 Claims, 7 Drawing Sheets

(56) References Cited

U.S. PATENT DOCUMENTS

| | | | | |
|---|---|---|---|---|
| 2007/0113323 | A1* | 5/2007 | Groves | A41B 15/02 2/279 |
| 2008/0184460 | A1 | 8/2008 | Jones | |
| 2009/0260395 | A1 | 10/2009 | Coleman | |
| 2014/0090151 | A1 | 4/2014 | McClellan | |
| 2014/0352034 | A1* | 12/2014 | Bhiro | A41B 15/02 2/279 |

* cited by examiner

PERMANENTLY FOLDED MAGNETIC POCKET SQUARE

CROSS REFERENCES AND RELATED SUBJECT MATTER

This application is a divisional of patent application Ser. No. 14/617,209, filed in the United States Patent Office on Feb. 9, 2015, from which priority is claimed and incorporated herein by reference in its entirety.

TECHNICAL FIELD

The present disclosure relates generally to the decorative display of folded handkerchiefs. More particularly, the present disclosure relates to a prefolded pocket square, which may be magnetically positioned in the breast pocket of a suit jacket to provide the appearance of a properly folded handkerchief.

BACKGROUND

While handkerchiefs have been carried by people for centuries for their absorbent properties, since the 1920s they have been donned for pure sake of fashion. Most commonly worn in the breast pocket of a man's suit or tuxedo jacket, the handkerchief is generally folded into a form commonly known as a "pocket square", with a portion thereof visibly protruding above the top edge of the pocket. This visible portion provides a decorative feature that enhances the appearance of the jacket.

The appearance of the handkerchief as it protrudes from the pocket is extremely important. In essence, the presence of the handkerchief is an added touch that conveys a sense of being "perfectly put together", and thus the handkerchief itself must be perfectly folded to convey that.

A variety of techniques have developed for folding the handkerchief in a manner that has the portion that protrudes from the pocket appear as clean and geometric as the suit jacket itself. Among these, the most common is the "single point" style, in which an isosceles triangle of protruding handkerchief is visually created, with its base at the top edge of the pocket, and the apex pointing straight up. Other similar styles involve overlapping swaths of fabric that culminate in a single upwardly extending point that is generally centered on the pocket.

While some might find the process of folding a handkerchief to be simple and routine, others find it to be as complicated and unfamiliar as tying a bow tie. Just knowing the procedure for folding the handkerchief is not sufficient, since pockets have different depths, and so there is the added difficulty of folding the handkerchief so that it protrudes just the right amount from its intended pocket. Even when folded precisely, however, they cannot be counted on to remain stationary within the pocket. Considering the level of visual perfection that is expected from the pocket square, the solution for many is to avoid it altogether.

Some have attempted to provide devices which hold a pocket square in place, generally using pins or the like. Such items generally pierce and thus permanently damage the handkerchief and/or suit, and are ineffective in maintaining the required appearance for the duration that the suit jacket is worn.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a pocket square that may be used in conjunction with a suit jacket having a breast pocket, which can be perfectly positioned to protrude perfectly from the suit pocket, and maintain such position for the duration that the jacket is worn. Accordingly, the present disclosure provides a pocket square which has a base, and a decorative portion that extends upwardly from the base. The base may be positioned within the pocket such that the decorative portion extends visibly from the pocket, and then held precisely in place.

It is another aspect of an example embodiment in the present disclosure that the base may be held perfectly in place without puncturing, perforating, or otherwise damaging the jacket or the pocket square. Accordingly, the base has a magnetically attractive core. Once the pocket square is perfectly positioned, a magnetic plate is positioned against an inside surface of the jacket to engage the magnetically attractive core to hold the jacket securely therebetween.

It is yet another aspect of an example embodiment in the present disclosure that the decorative portion of the pocket square is permanently configured so that it maintains the appearance of a perfectly folded handkerchief indefinitely. Accordingly, the decorative portion comprises fabric that is folded and stitched to provide the appearance of a folded handkerchief and which will remain intact throughout its use.

Accordingly, the present disclosure describes a pocket square, for use with a jacket having an inside surface, an outside surface, and a pocket on the outside surface having a top edge. The pocket square has a base having a top edge and a magnetically attractive core, and a decorative portion extending from the top edge of the base. When the base is placed in the pocket its top edge is aligned with the top edge of the pocket, visibly displaying the decorative portion above the pocket. A magnetic plate is aligned with the magnetically attractive core and placed against the inside surface of the jacket to positionally fix the base within the pocket, such that the pocket square remains in position for the duration that the jacket is worn.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
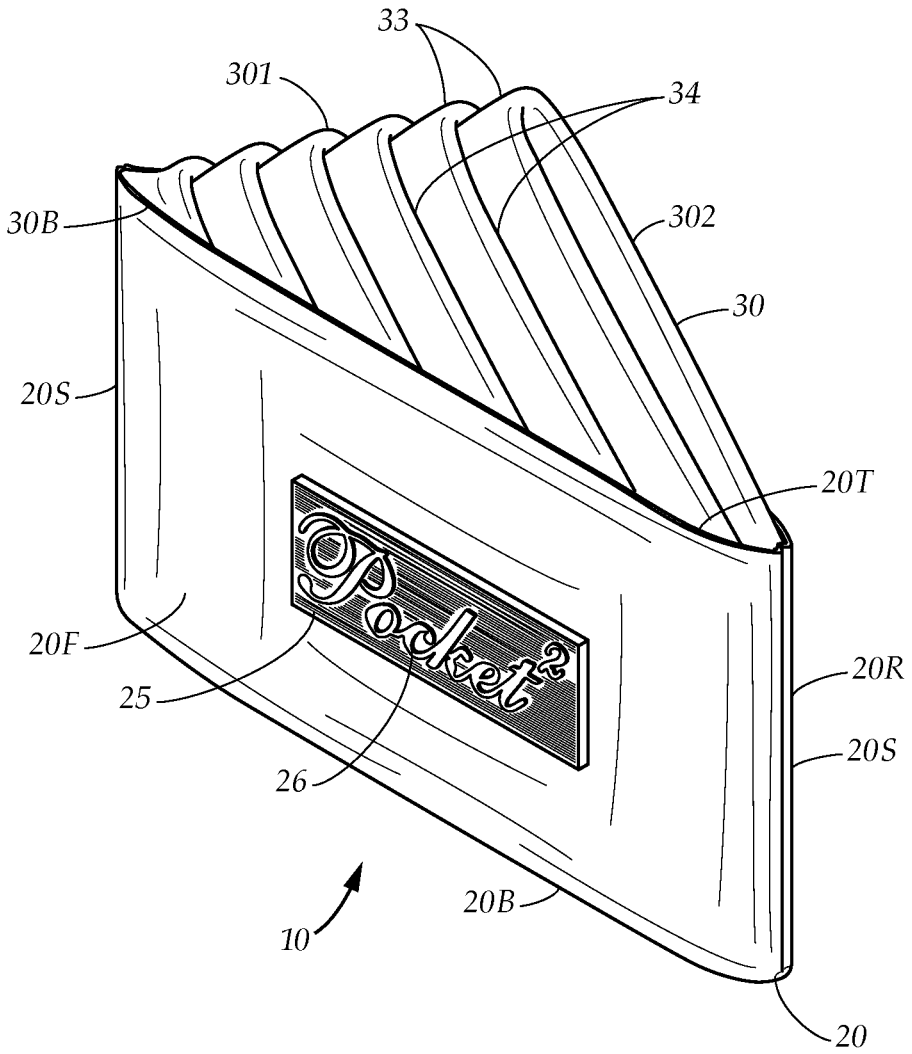
FIG. 1 is diagrammatic perspective view, illustrating the pocket square, per se.

FIG. 1 illustrates a pocket square 10, comprising a base 20, and a decorative portion 30. The base 20 has a front 20F, a rear 20R, a pair of sides 20S, a bottom edge 20B, and a top edge 20T. The decorative portion 30 is made of fabric, has a bottom edge 30B, and comes to an apex 31 opposite from the bottom edge 30B. The decorative portion 30 is fixed to the base 20 and extends upwardly from the top edge 20T of the base 20. The decorative portion 30 may be arranged in the shape of an isosceles triangle having a first edge 301 and a second edge 302. The first edge 301 ascends toward the apex 31 (from the bottom edge 30B) and the second edge 302 descends from the apex 31 (toward the bottom edge 30B). The decorative portion 30 is preferably made of a plurality of fabric parts preferably including a plurality of cascading fabric strips 33 that have descending edges 34. The fabric parts meet and are attached along the first edge 301, and may extend substantially parallel to the second edge 302.

A logo plate 25 is affixed to the front 20F of the base 20, which may bear a logo 26 thereon. Note that in the example provided herein, the logo bears the trade name POCKET$^2$ ("Pocket Squared").

Figure 2:
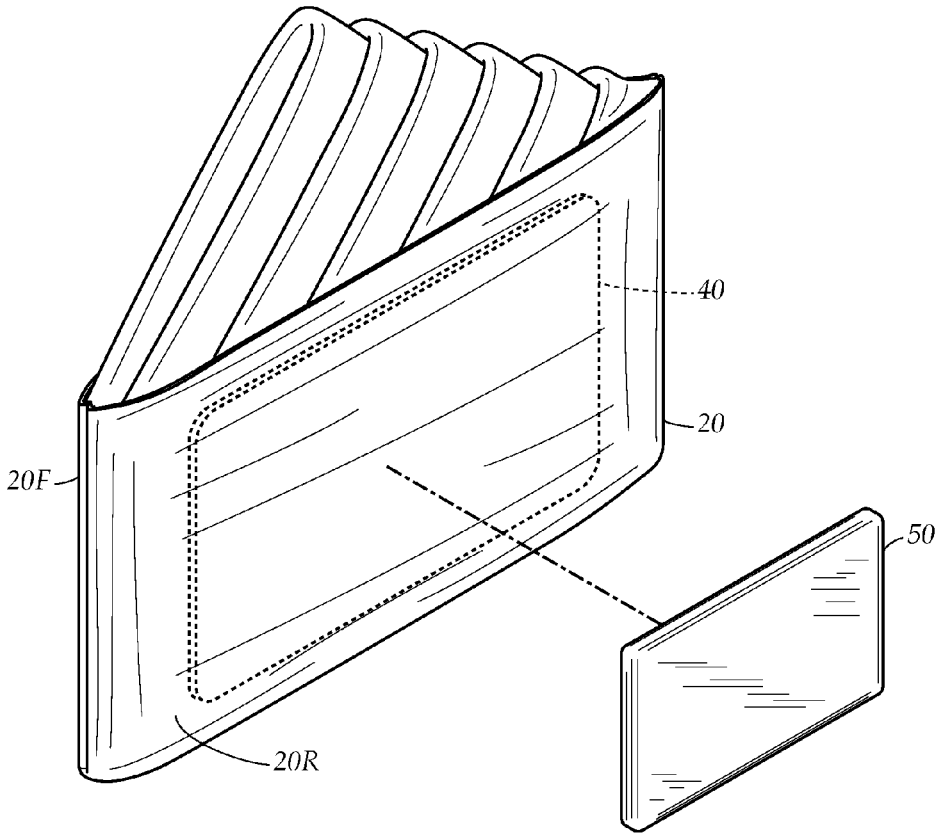
FIG. 2 is a diagrammatic perspective view, showing a rear panel of the pocket square, indicating a magnetically attractive core within the base of the pocket square, and showing a magnetic plate which it operates in conjunction therewith.

Referring to FIG. 2, a magnetically attractive core 40 is located within the base 20, hidden from view between the front 20F and rear 20R. A magnetic plate 50 is selectively mated with the magnetically attractive core 40. The magnetic plate 50 is strong enough so that fabric of approximately 1/32 to 1/16 inch can be extended between the magnetic plate 50 and magnetically attractive core 40 while the magnetic plate 50 securely holds to the magnetically attractive core 40 and thus holds the position of the magnetically attractive core 40 and magnetic plate 40 on said fabric. Note that in order for the magnetically attractive core 40 and magnetic plate 50 to attract each other, at least one must be a magnet and the other a metal place made of iron, nickel, or cobalt. Among these, preferably the magnetically attractive core 40 is a metallic plate, and the magnetic plate 50 is a magnet. Clearly, however, the magnetic status of these two elements may be interchanged while maintaining the functionality required herein.

Figure 3:
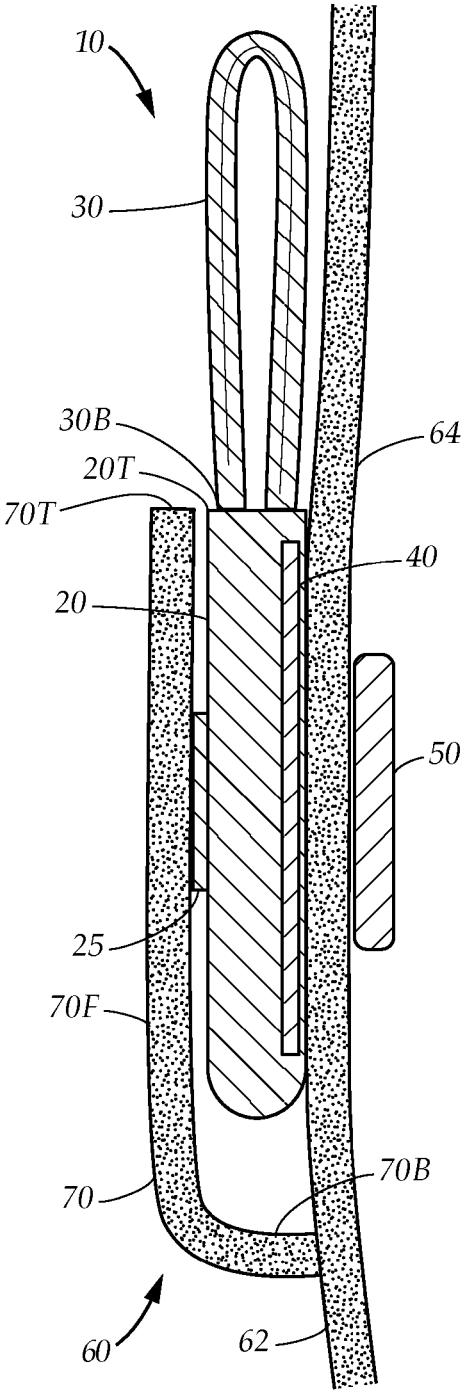
FIG. 3 is a side elevational view with parts broken away of a jacket pocket, illustrating the pocket square positioned within the pocket, and held in place by the magnetic plate extending inside the jacket.
Figure 4:
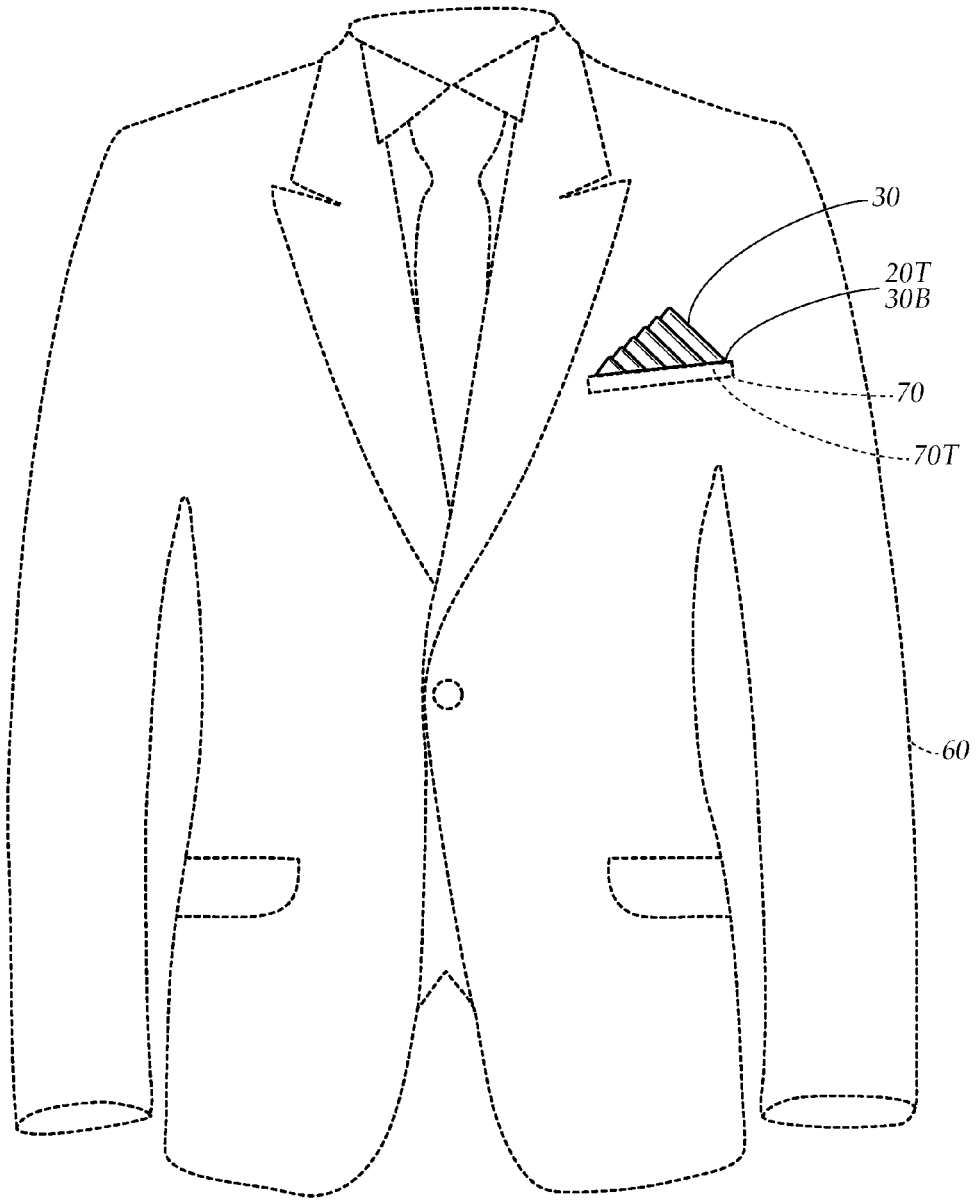
FIG. 4 is a front elevational view, illustrating a jacket in phantom lines, with the decorative portion of the pocket square protruding from the breast pocket.

FIG. 3 and FIG. 4 illustrate a jacket 60, having an outside surface 62, and an inside surface 64. The jacket has a pocket 70 attached on the outside surface 62. The pocket has a front panel 70F, a top edge 70T and a bottom 70B. The pocket has an interior volume defined between the front panel 70F and outside surface 62 of the jacket 60, and a pocket depth between its top edge 70T and bottom 70B. Also illustrated in FIGS. 3 and 4, the pocket square 10 is located in the pocket 70, with the base 20 extending within the interior volume, between the front panel 70F of the pocket 70 and the outside surface 62 of the jacket 60 with the logo plate 25 facing the front panel 70F, and the decorative portion 30 protruding visibly above the top edge 70T. In particular, the top edge 20T of the base 20 and the bottom edge 30B of the decorative portion 30 are aligned with the top edge 70T of the pocket 70. The magnetic plate 50 is positioned against the inside surface 64 of the jacket 60, aligned with and extending parallel to the magnetically attractive core 40 extending within the base 20 of the pocket square 10. Note that the bottom 20B of the base 20 is suspended well above the bottom 70B of the pocket 70. Accordingly, regardless of the pocket depth, the pocket square is held perfectly in position with the top edge 20T of the base 20 and the bottom edge 30B of the decorative portion 30 aligned with the top edge 70T of the pocket 70.

Figure 5A:
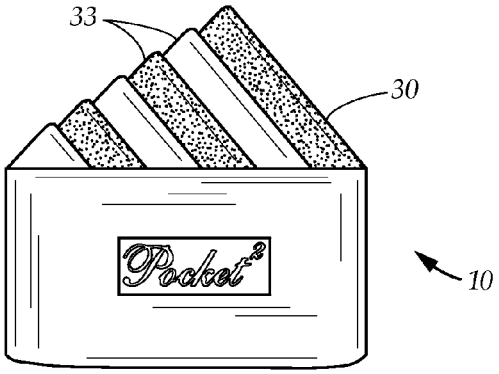
FIGS. 5A, 5B, and 5C, illustrate various embodiments having fabric strips in various combinations to provide various aesthetic properties.
Figure 5B:
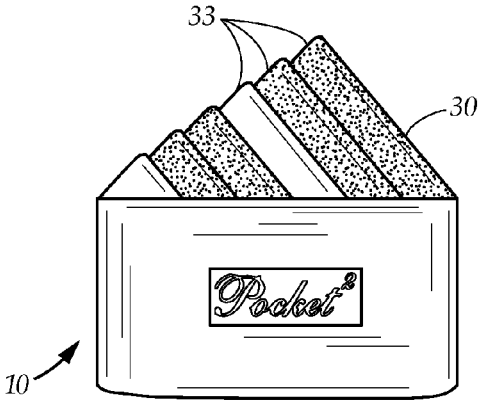
Figure 5C:
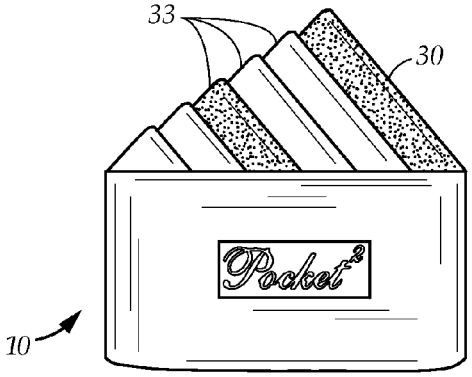

FIGS. 5A, 5B, and 5C show example embodiments including various configurations of the decorative portion 30 of the pocket square 10, wherein the fabric strips 33 can be configured to have alternating colors and/or materials, including various combinations wherein adjacent strips have the same or alternating colors and materials.

Figure 6A:
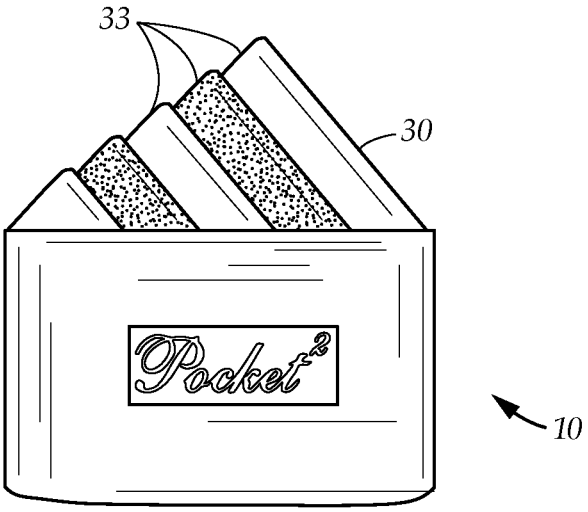
FIGS. 6A and 6B illustrate differing numbers of fabric strips to provide different aesthetic properties.
Figure 6B:
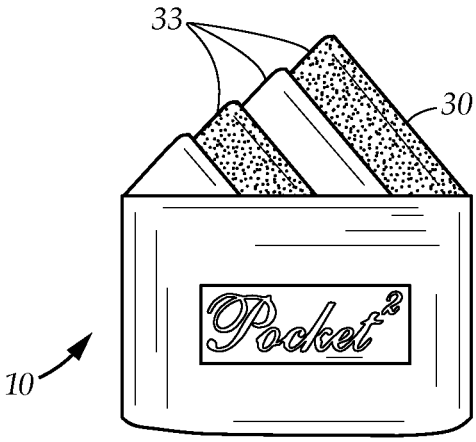

FIGS. 6A and 6B show example embodiments, wherein different numbers of fabric strips may be employed in different versions of the pocket square 10. For example, FIG. 6A shows five fabric strips 33, while FIG. 6B shows four fabric strips 33 employed to create the decorative portion 30.

Figure 7A:
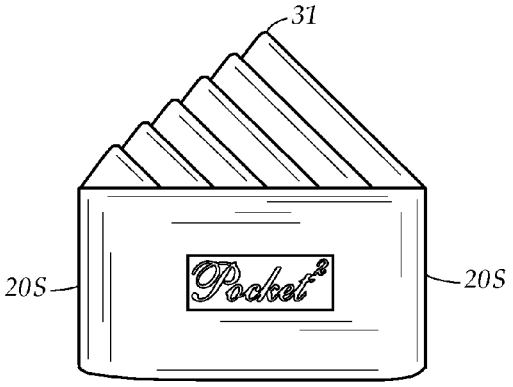
FIGS. 7A, 7B, and 7C illustrate differing fabric configurations, with differing centerings of the point to provide different aesthetic properties.
Figure 7B:
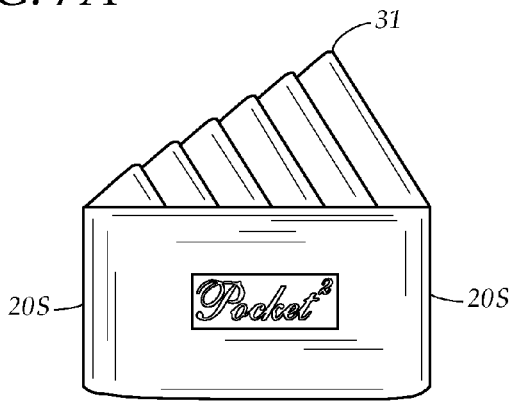
Figure 7C:
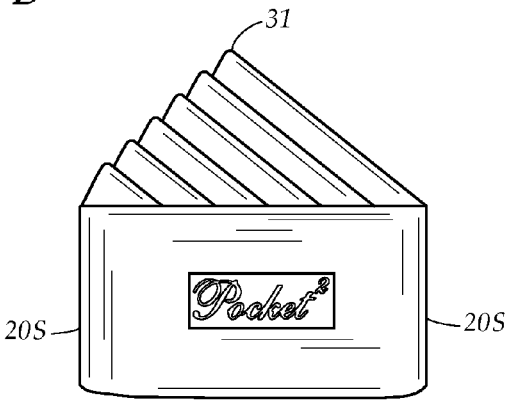

FIGS. 7A, 7B, and 7C show example embodiments, wherein the apex 31 may be centered between the sides 20S of the base 20, or may be in any desired non-central position.

Referring now generally to FIGS. 1, 2, 3, and 4, when stored, the magnetic plate 50 is magnetically engaged with the magnetically attractive core 40 and thereby positioned against the rear 20R of the base 20. In use, the magnetic plate 50 is removed or disengaged from the base 20. The base is then positioned within the pocket 70 of the jacket 60 to display the decorative portion 30. The top edge of the base 20T is aligned with the top edge of the pocket 70T so that the decorative portion 30 is visible immediately above the pocket 70. The pocket square 10 is held steadily in this position while the magnetic plate 50 is brought toward the inside surface 64 of the jacket and positioned and aligned with the base 20 (from inside the jacket). The magnetic plate 50 is engaged with the magnetically attractive core 40 so that the jacket 60 is held tightly between the base 20 and magnetic plate 40, thus fixing the position of the pocket square 10 within the pocket of the jacket 60 against the outside surface 62 of the jacket 60 and the magnetic plate 40 against the inside surface 64, and maintaining the position of the decorative portion 30 through the duration that the jacket is worn. Thereafter, removal involves peeling the magnetic plate 50 away from the inside surface 64 of the jacket 60, removing the base 10 from the pocket 70, and restoring the magnetic plate 50 to the rear 20R of the base 20.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a pocket square which is configured to easily and securely position in the jacket pocket of the user, and hold its shape and position for the duration the jacket is worn. The disclosure is illustrated by example in the drawing figures, and throughout the written description. It should be understood that numerous variations are possible, while adhering to the inventive concept. Such variations are contemplated as being a part of the present disclosure.

What is claimed is:

1. A pocket square method, using a pocket square having a base having a front, a back, a top edge and a magnetically attractive core between the front and back of the base, a decorative portion fixedly attached to and extending upwardly from the top edge of the base, and a magnetic plate, for use with a jacket having an inside surface, an outside surface, and a pocket attached on the outside surface having a top edge and a bottom, comprising the steps of:

displaying the decorative portion on the jacket immediately above the pocket by positioning the base in the pocket by aligning the top edge of the base with the top edge of the pocket; and maintaining the decorative portion in position by holding the base against the outside surface of the jacket while holding the magnetic plate against the inside surface of the jacket by attracting the magnetic plate toward the magnetically attractive core.

2. The pocket square method as recited in claim 1, wherein the base has a bottom edge, and wherein step of positioning the base in the pocket further comprises suspending the base above the bottom of the pocket.

3. The pocket square method as recited in claim 2, wherein the decorative portion is made of fabric and arranged as a triangle that extends from the top edge of the base, and has an apex opposite from the top edge of the base.

4. The pocket square method as recited in claim 3, wherein the decorative portion has a first edge that ascends to the apex and a second edge that descends to the top edge of the base, wherein the decorative portion is made of a plurality of fabric strips that meet along the first edge and extend parallel to the second edge.

5. A pocket square method, using a pocket square having a base having a top edge and a magnetically attractive core, a decorative portion extending from the top edge, the decorative portion is made of fabric and arranged as a triangle that extends from the top edge of the base and has an apex opposite from the top edge of the base, and using a magnetic plate, for use with a jacket having an inside surface, an outside surface, and a pocket attached on the outside surface having a top edge and a bottom, comprising the steps of:

displaying the decorative portion on the jacket immediately above the pocket by positioning the base in the pocket by aligning the top edge of the base with the top edge of the pocket; and maintaining the decorative portion in position and suspending the base above the bottom of the pocket by holding the base against the outside surface of the jacket while holding the magnetic plate against the inside surface of the jacket by attracting the magnetic plate toward the magnetically attractive core.

6. The pocket square method as recited in claim 5, wherein the decorative portion has a first edge that ascends to the apex and a second edge that descends to the top edge of the base, wherein the decorative portion is made of a plurality of fabric strips that meet along the first edge and extend parallel to the second edge.

7. A pocket square method, comprising the steps of:

providing a jacket having an inside surface, an outside surface, and a pocket attached on the outside surface having a top edge and a bottom;

a pocket square having a base having a top edge and a magnetically attractive core, a decorative portion fixed to and extending from the top edge of the base, and a magnetic plate;

displaying the decorative portion on the jacket immediately above the pocket by positioning the base in the pocket; and suspending the base above the bottom of the pocket while by aligning the top edge of the base with the top edge of the pocket; and holding the base against the outside surface of the jacket while holding the magnetic plate against the inside surface of the jacket by attracting the magnetic plate toward the magnetically attractive core.

8. The pocket square method as recited in claim 7, wherein the base has a front and a rear, and wherein the magnetically attractive core extends between the front and rear of the base.

9. The pocket square method as recited in claim 8, wherein the decorative portion is made of fabric and arranged as a triangle that extends from the top edge of the base, and has an apex opposite from the top edge of the base.

10. The pocket square method as recited in claim 9, wherein the decorative portion has a first edge that ascends to the apex and a second edge that descends to the top edge of the base, wherein the decorative portion is made of a plurality of fabric strips that meet along the first edge and extend parallel to the second edge.

* * * * *